US006435389B1

(12) United States Patent
Sucher

(10) Patent No.: US 6,435,389 B1
(45) Date of Patent: Aug. 20, 2002

(54) TOOL BELT CARRIER

(76) Inventor: Eric Sucher, 1921 NE. Wasco St., Portland, OR (US) 97232

( * ) Notice: Subject to any disclaimer, the term of this patent is extended or adjusted under 35 U.S.C. 154(b) by 0 days.

(21) Appl. No.: 09/570,670

(22) Filed: May 15, 2000

Related U.S. Application Data

(60) Provisional application No. 60/134,347, filed on May 14, 1999.

(51) Int. Cl.[7] ..... A45C 15/00

(52) U.S. Cl. ..... 224/576; 224/577; 224/584; 224/904; 182/129; 206/373; 248/210

(58) Field of Search ..... 224/576, 577, 224/584, 904; 206/373, 372, 349; 220/735; 182/129; 248/210, 211

(56) References Cited

U.S. PATENT DOCUMENTS

| | | | | | |
|---|---|---|---|---|---|
| 4,953,765 | A | * | 9/1990 | Little et al. | 224/151 |
| D317,206 | S | * | 5/1991 | Cagle | D25/68 |
| 5,639,003 | A | | 6/1997 | Utzinger, III | 224/577 |
| 5,649,623 | A | * | 7/1997 | Kornblatt | 206/373 |
| 5,813,530 | A | | 9/1998 | Kornblatt | 206/373 |
| 5,833,095 | A | | 11/1998 | Russell | 224/576 |
| 5,971,101 | A | * | 10/1999 | Taggart | 182/129 |
| 6,098,748 | A | * | 8/2000 | Harper, Jr. et al. | 182/129 |
| 6,179,185 | B1 | * | 1/2001 | Dancyger | 224/576 |
| D445,202 | S | * | 7/2001 | Lungo | D25/68 |

* cited by examiner

*Primary Examiner*—Stephen K. Cronin

(57) ABSTRACT

A tool and parts carrier, capable of supporting a standard tool belt with tools displayed and easily accessible. The invention provides a metal framework consisting of two approximately rectangular sides, joined along the top by a hinge. The hinged sides spread open at the base to form an "A" shaped, self standing structure, utilizing the top of the rectangle as a carrying handle, and folding closed for easier carrying and storage. Each side is covered with a flat sheet spanning the carrier from front to back and from the bottom part way up the side. A horizontal, ridged prong extends along the width and above the flat sides of the carrier onto which a standard tool belt's tool bags may be threaded and hung on the prongs, supported by the sides. A detachable tray or trays attach to the carrier's framework to hold extra parts and tools. The carrier can be transported by hand or is self-standing, or attaches to a variety of objects such as ladders, railings, and joists etc.

4 Claims, 12 Drawing Sheets

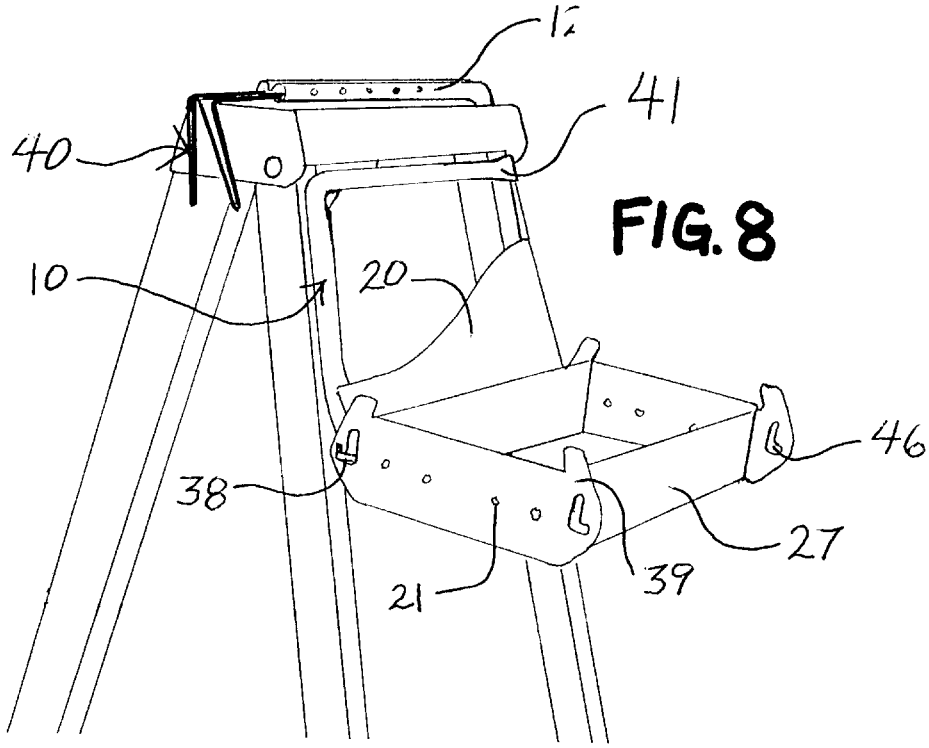
FIG. 8
FIG. 8A
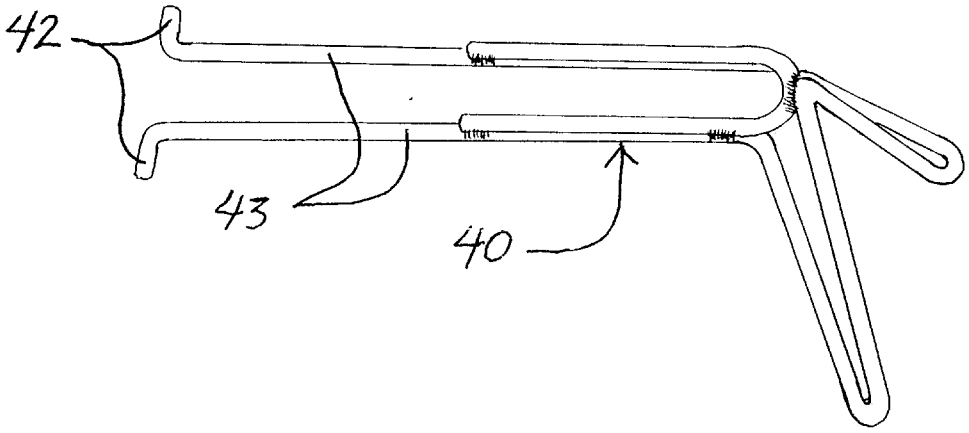

TOOL BELT CARRIER

CROSS-REFERENCE TO RELATED APPLICATIONS

This application claims benefit under 35 U.S.C. 119 (e) of U.S. Provisional Application Serial No. 60/134,347 filed May 14, 1999.

FIELD OF INVENTION

This invention relates to tool carriers and organizers, specifically to transporting and using tool belts.

BACKGROUND—DISCUSSION OF PRIOR ART

Tool belts are designed to be worn on the workers body, displaying and organizing tools and parts within easy reach of the worker. But frequently the work requires getting into positions or situations where losing tools is a hazard or a tool belt gets in the way and can't be worn or the tool belt becomes physically uncomfortable during long hours of work.

Plastic buckets fitted with pocketed aprons, cloth bags with pockets inside and outside, various plastic and metal boxes with and without drawers, are a partial solution. But having to transfer tools from the tool belt to a bucket, bag or box and back again, takes time. Nothing is as familiar and easy to use as a workers personal tool belt, where they know exactly what tools they have and where everything is.

Taking a tool belt onto a ladder can be problematic and has been addressed by U.S. Pat. No. 5,639,003 to Utzinger (Jun. 17, 1997). Utzinger shows a pocketed apron that straps to a stepladder and converts to a tool apron.

Utzinger's invention being of limited size and structure is also of limited use, and will not work with a standard tool belt or the type and the amount of tools commonly used in the electrical, carpentry or most other construction trades. While being useful on a stepladder, his invention is not self-standing, and must be worn if not strapped to a ladder, thus limiting it's usefulness.

When worn, Utzingers tool apron concentrates the weight of the tools to the front of the workers torso. Suspenders could help with this imbalance but would be difficult to use with his design. The resulting weight distribution would make his tool apron uncomfortable to wear with anything but the lightest of tools and his design provides no extra room for parts and tools.

U.S. Pat. No. 5,813,530 to Kornblatt (Sep. 29, 1998), shows a tool belt that attaches to a tool box that attaches to a ladder. A typical tool belt used in construction, has tool bags and tools dangling well below the waist belt. If such a typical tool belt were used with Komblatt's invention, the long tools and tool bags of the tool belt would hit the floor before the 'box' came to rest, upsetting the box and or the tools. Thus the user would have to take a typical construction tool belt off Kornblatt's carrier when not situated on a ladder or being worn on the body. Storage of this invention with a typical tool belt attached would be difficult for the reason stated above.

Komblatt's invention must be worn or be installed on a ladder, and then only a stepladder of certain top step proportions, with a single tray limited in carrying capacity to those same proportions.

Transforming Kornblatt's invention back and forth from a tool belt worn, to a ladder, would be time consuming given the attachment straps and belt tightening procedure given.

The more frequent the change over was required the less useful this invention would be.

U.S. Pat. No. 5,833,095 to Russell (Nov. 10, 1998), shows a typical plastic bucket fitted with straps and locking parts holding a variety of pouches and tools. The straps also convert to a kind of tool belt.

Russell has shown a way to combine a bucket type carrier with a tool belt, but in a cumbersome and complicated manner, requiring a multitude of protruding parts and variety of specially made pouches and tool holders specifically designed to fit only his design. Russell's design does not work on ladders, is complicated to use, and would be expensive to manufacture and purchase.

Transferring a heavily loaded tool belt to the bucket would be difficult to coordinate given buckets tend to be unstable when loaded unevenly. Russell's invention could concentrate a lot of weight high and to one side causing a spill if the worker was not careful. And as with Komblatt's invention, the more frequent transferring one's tool belt became necessary, the less useful this invention would be.

Russell's design will not accommodate a standard tool belt used in the trades today, thus requiring the worker to completely replace and adapt to a new system of tool management.

SUMMARY

In accordance with the present invention, a tool and parts carrier, capable of supporting a tool bag or tool belt with tool bags, of the type usually worn on the body of the worker. By attaching the tool belt or tool bags onto the carrier, the user is able to utilize the familiarity, accessibility and organizational advantages of the tool belt in a variety of situations where tool belts would be inconvenient or problematic.

OBJECTS AND ADVANTAGES

Accordingly, several objects and advantages of my invention:

a) To provide a tool belt carrier that works with the type of tool belts already commonly used in the trades.

b) Simple-design, easy to use and transport, inexpensive to manufacture.

c) Self standing, not dependant on a bucket or ladder to function.

d) Attaches to a wide variety of objects: ladders, lift platform railings, between floor joists, wall nails, or worn over the shoulder hanging from suspenders. Keeps the carrier and tools closer to the worker in more working situations.

e) Faster and easier to transfer the tool belt back and forth from the carrier to the worker's body, saving the worker time and energy.

f) Multiple, removable trays, provide plenty of extra space for tools and parts. Enables the worker to choose the amount of tray space needed and the tray configuration, to fit the job at hand.

g) The framework folds with the tool belt on or off, making carrying and storage easier.

h) 'A' shaped framework has a broad base and low C.G., making the carrier very stable.

i) Slanting sides display the tools at an ideal angle for easy recognition and access.

j) The tool bags loops can be utilized to attach the tool belt to the carrier instead of the waist belt. A more secure, easier to load and unload design.

k) Slick plastic sides extending around the front of the framework, make loading/unloading smoother, fewer hang ups and snags.

l) The handle is a sturdy surface on which to work, providing a grooved guide and measure, for cutting conduit and pipe.

m) Contoured plastic sides, high in the front and low in the back, support the tool bags yet allow side access to the inner tray's contents.

n) The tray hook design allows multiple trays to be attached, also serving as a means of supporting the carrier between joists when used in an attic or before flooring is laid over floor joists.

o) Trays "lock" securely onto the carrier, releasing only when the tabs are bent out-ward.

p) The handle hook inverted upward, serves as a cutting guide for cutting conduit or cable.

q) The trays attach to the carrier in two positions, helping to keep the trays level depending on the tool belt carriers attitude.

r) 'Off setting' the prongs outward, away from the sides, makes loading/unloading easier.

s) Suspenders need not be taken off when using the carrier. The suspenders can also be used as a shoulder strap making transportation of the carrier hands free.

t) One or more of the tool bags can be attached to the carrier, without the belt and or suspenders, depending on the particular needs of the job.

u) The framework extender allows the tool carrier to attach and be used on railings with a large distance between the top and next lower railing.

v) The trays can be attached to the front and back of the carrier as well as the sides.

w) The handle has ruler markings for measuring (not shown), particularly handy when using the handle as a cutting surface for conduit and cable.

Further objects and advantages of my invention will become apparent from a consideration of the drawings and ensuing description.

DRAWING FIGURES

FIG. 8 is a perspective view of the carrier of FIG. 6, attached to a ladder, utilizing the hook member and a tray attached to the carrier framework.

FIG. 8A is a perspective view of the hook member shown in FIGS. 6, 8, 9.

REFERENCE NUMERALS IN DRAWINGS

#10 framework
#11 frame section
#12 handle
#13 prong
#14 prong end taper
#15 hinge
#16 folding-lock brace
#17 washer
#18 corner brace
#19 bottom corner
#20 plastic side
#21 pop rivet
#22 bottom foot
#23 extension foot
#24 waist belt
#25 belt loop
#26 tool bag
#27 tray
#28 tray hook
#29 prong hook
#34 metal conduit
#36 handle groove
#37 triangle brace
#38 tray angle hook
#39 tray tab
#40 handle extension hook
#41 prong end flair
#42 handle extension keeper
#43 handle extension prong
#44 handle hook hole
#45 framework extender
#46 tray tab hole
#47 frame handle
#48 frame hook
#49 frame-prong brace
#50 frame structure
#51 double prong
#52 plastic sheet

DESCRIPTION OF THE PREFERRED EMBODIMENT FIGS. 1, 2, 3, 4, 5

Figure 1:
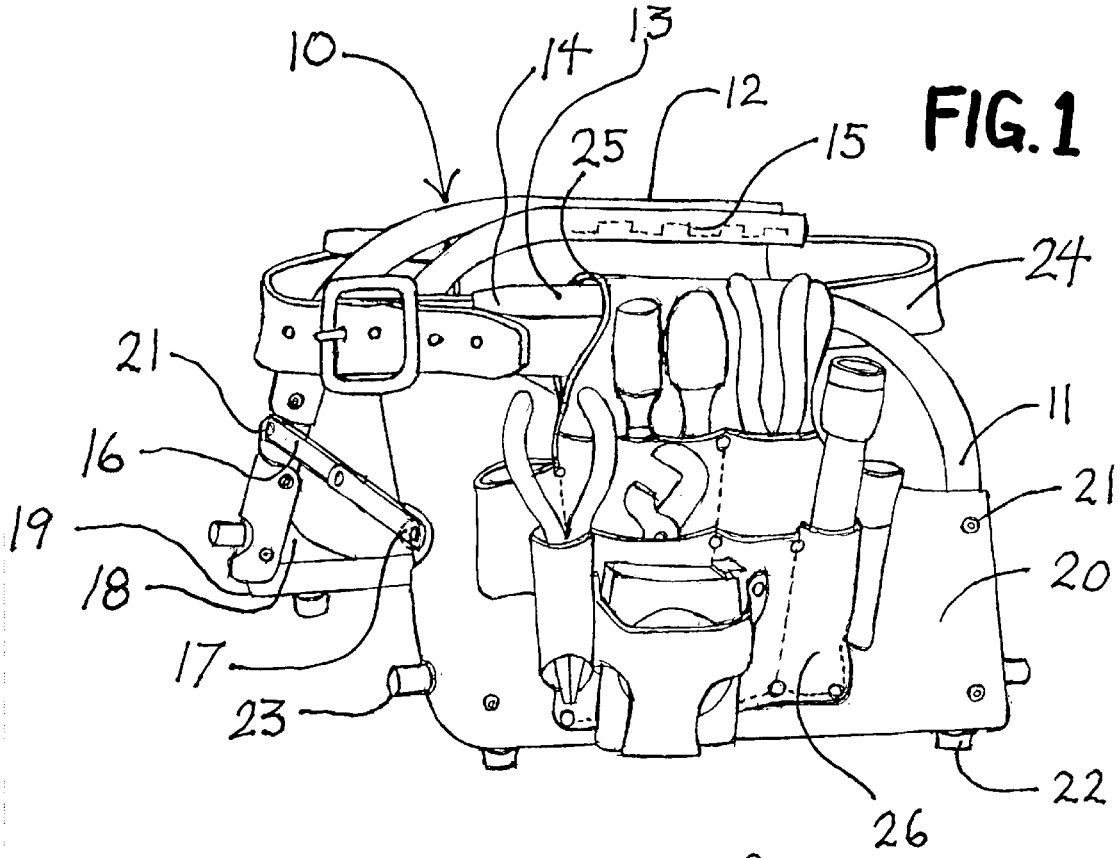
FIG. 1 is a perspective view of a tool belt carrier embodying features of this invention operatively supporting a tool belt and disposed on an underlying floor.

The invention has a framework #10, made of ½ inch metal EMT pipe commonly used in the electrical trade, see FIG. 1. The framework is constructed by cutting a 10 ft length of pipe in half, each half will become a frame section #11. Each frame section is bent at 90° in four places. The approximate location of the four bends in each frame section can be found by dividing its length into five equal parts, the four marks between the ends of the pipe give the approximate location of each bend.

The first bend is made using a standard electricians conduit bending tool, at the first of the four marks on the pipe section. This bend defines one half of a handle #12, of the framework.

Figure 4:
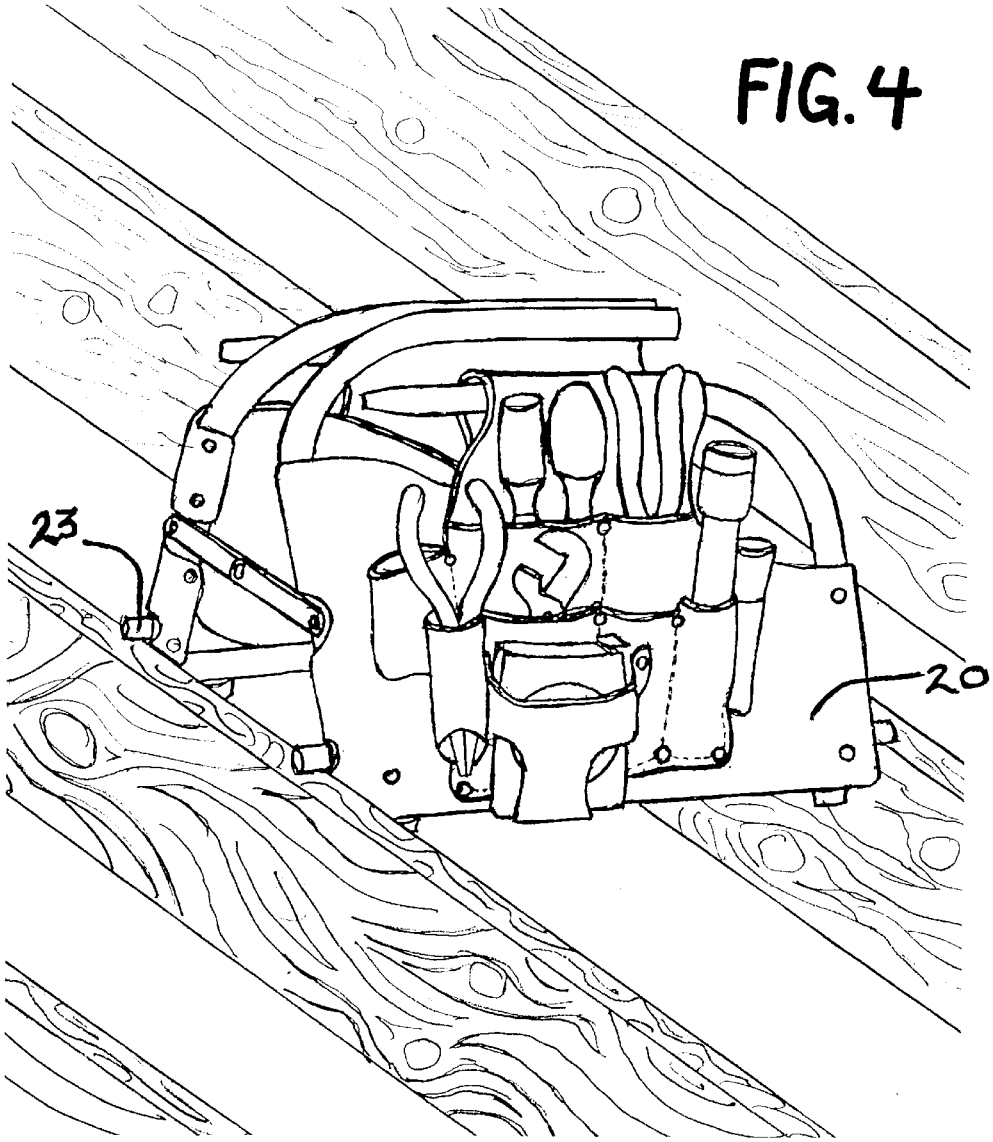
FIG. 4 is a fragmental perspective view of the carrier of FIG. 1 in use supported on and spanning joist members.

The second bend is a sharp 90° and forms a bottom corner #19, see FIG. 1. The third bend (also a sharp 90°) forms the opposite bottom corner of the frame section (not shown). The distance between the second and third bends is made such that the framework will slide between floor joists on 16" centers with minimal clearance, (see FIG. 4).

With the frame section held firmly flat on the floor, another bend is created at location of the third bend by lifting the pipe upward until the forth mark rests at approximately 2" above the floor, thus creating an upward offset.

The forth and last bend is made using the pipe bending tool approximately 2" or 3" short of the forth mark. This creates a shorter segment of pipe between the $3^{rd}$ and $4^{th}$ bend, thus lowering the height of a prong #13, (see FIG. 1), two inches below the level of the handle when the framework is viewed from the side, while in the vertical, standing position.

The second frame section is bent in the same manner as the first but the offset at the third bend is made in mirror reverse from the first frame section. A corner brace #18, is brazed onto the outside corner at each of the four sharp bottom corners to reinforce those bends, see FIG. 1.

The two frame sections are joined together by a hinge #15 (a long piano type hinge underneath and spanning the length of the handle #12). The hinge (best shown in FIG. 2) is brazed on between and underneath the two halves of the handle, leaving a handle groove #36 on the top of the handle. Thus hinged, the frame sections can be closed together or spread apart, wide enough to accommodate a tray #27, (also shown in FIGS. 1*a* and 2).

When the two frame sections are joined together, the prongs of the framework will be parallel and on opposite sides of the handle, when viewed from above.

The length of the prongs and the handle can now be trimmed to a desirable length just short of the horizontal width of each frame section, as shown in FIG. 1. The section of pipe between the handle and the first bottom corners forms a vertical barrier behind which the prongs protrude, thus protecting the worker from being impaled or injured by the prongs.

A prong end taper #14, is formed by progressively flattening both sides of the last 2 inches of the prong's end with a hammer to a pointed end, shaped so the prong will insert into a belt loop #25, along side a waist belt #24.

Figure 2:
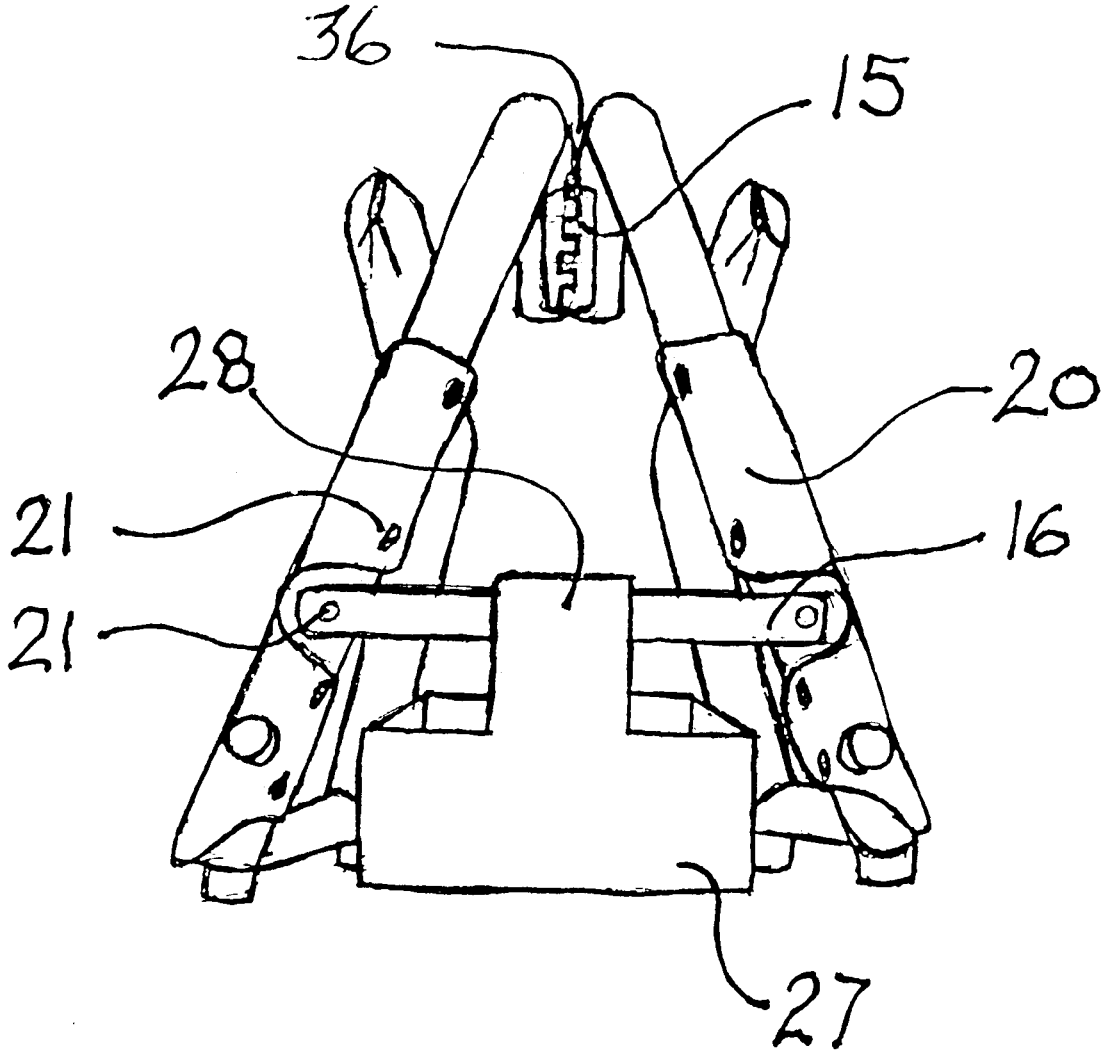
FIG. 2 is a side view of the carrier of FIG. 1 with the tool tray attached thereto.

A folding-lock brace #16, is now attached, one at the front and one at the back of the framework, joining the frame sections together (See FIG. 2). The folding-lock braces are positioned similarly to the horizontal line in the letter 'A'. Both ends of each folding-lock brace are secured to the frame sections by a pop rivet #21, with a washer #17, placed between the brace #16 and the frame section at each rivet #21. The placement of the folding lock braces must allow the frame sections to open and lock in a position wide enough and high enough to accommodate the tray #27.

A plastic side #20, partially covering each frame section is made of translucent white 0.060 high density polyethylene plastic (See FIG. 1). The plastic sides are attached by a series of rivets #21 along the perimeter to the bottom and both sides of the frame sections #11, (see FIG. 1). The top edge of each plastic side is shaped higher in front (toward the prong end taper #14), then lower in back, see FIG. 4.

On the front, (prong end taper side) of each frame section, the plastic sheet is wrapped around the frame #11 and riveted #21, to the inside of the frame section (best shown in FIG. 2). This minimizes edges that could catch and bind a tool bag #26, as it slides past the front portion of the frame section of the invention.

A bottom foot #22, made of rubber or plastic and readily available at a good hardware store, is attached by sheet metal screw to the framework, see FIG. 1 . One bottom foot underneath each bottom corner. The invention rests on these bottom feet when in the self standing, open position. An extension foot #23, (same type as the bottom foot #22) are attached 2" above the bottom corners on the front and back sides of the frame sections, one above each bottom corner, on which the invention can rest when placed between two typical floor joists spaced at 16" on center, (see FIG. 4).

Figure 1A:
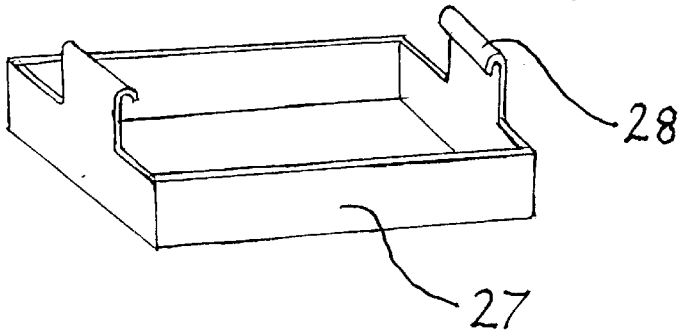
FIG. 1A, is a perspective view of a tool tray for attachment to the carrier illustrated in FIG. 1.

The tray #27, is made of $1/16^{th}$ inch white polycarbonate plastic sheet, made to fit inside and between the spread open frame sections #11, (best shown in FIGS. 1A, 2). A tray hook #28, is attached or formed from the front and backsides of the tray. These hooks can be formed using a heated wire to soften the plastic sheet to the form shown in FIG. 1*a*. The tray hooks are positioned such that the tray will suspend from the fully opened folding-lock braces, see FIG. 1 and FIG. 2.

A prong hook #29, or hooks, (see FIG. 5), can be added to the prong to attach tool belts without belt loops to the framework. The prong hook is made of 14 ga sheet metal with a 12 gauge steel wire welded on, to form a hook. The prong hook is removable by releasing a set screw, (not shown).

OPERATION OF THE INVENTION FIGS. 1, 2, 3, 4, 5

In all figures, the waist belt and or suspenders can remain attached to the tool bags or not (according to the needs of the worker) but are not drawn in some figures to simplify the illustrations.

A typical 'tool belt' (see FIG. 1) is composed of a waist belt #24, worn around the users waist, usually with two main tool bags #26, hung from the waist belt. By threading the waist belt through belt loops #25, sewn into the top of the tool bags, the tool bags are hung from the waist belt.

Suspenders are often part of the tool belt assembly and grip the waist belt between the tool bags to shift some of the weight of the tool belt to the workers shoulders. The suspenders may remain attached to the tool belt or taken off when the tool belt is installed onto the tool carrier.

Installing a tool belt onto the carrier can be accomplished in either the open or closed framework positions, see FIG. 1. To install a typical tool belt on the invention, the belt loops #25, are positioned in front of and in line with the prongs #13, of the invention. The prong end #14, slips inside the tool bag's belt loops #25 (along side the waist belt if attached). The tool bags are then pulled to the approximate center of the framework on the prongs, one or more tool bags on each side, supported by plastic side #20, of the invention.

If a large third tool bag is present on the tool belt, the third (middle) tool bag can rest against the brace #16, and on the framework #10, of the invention. The third bag is thus suspended by the waist belt #24, while the other two large tool bags hang centered on the prongs. With a large third bag resting against the backside of the framework, it is advisable to buckle the waist belt around the framework to keep the tool bags from being pulled off the prongs by the weight of the third tool bag dangling from the waist belt, see FIG. 1. If extra side bags or holsters (a drill for example) are present on the particular tool belt, they can be threaded onto the prongs along with the main tool bags.

Once the tool belt is attached to the invention, the user can lift the assembly by the handle #12, with the tool bags suspended from the prongs of the invention and the tool bags #26, will rest stably against the plastic sides #20. The invention with tool belt attached can be carried with the framework spread open or in the closed position.

Figure 3:
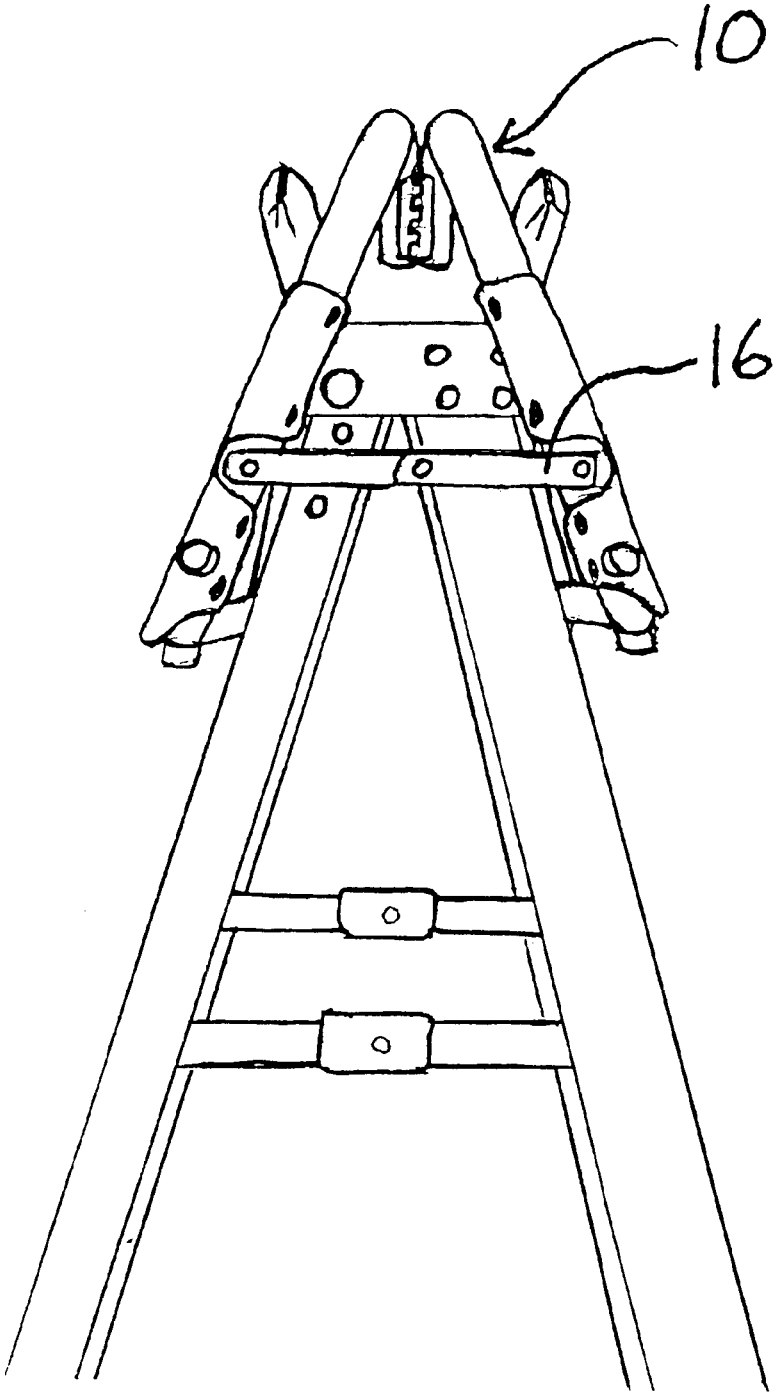
FIG. 3 is a fragmentary side elevation showing the carrier of FIG. 1 supported on a stepladder.

When the worker wishes to use the invention on the floor, the frame sections #11, are manually spread and locked into the open position using the braces #16 (see FIG. 1). The invention can now be placed on the floor resting on the bottom feet #22, or on top of a ladder (see FIG. 3), or between floor or ceiling joists resting on extension feet #23, see FIG. 4.

The tray #27, (see FIG. 2) is used to hold extra parts, tools, and trash lock etc. To remove the tray, the tray #27 is lifted upward and off the brace #16 while the tray hooks #28 are bent outward. Thus released, the tray #27, can then be lowered out the bottom of the framework #10, or the framework may be lifted off the tray. The reversed procedure will install the tray. When installed, the inside tray #27 can be accessed by reaching though the framework from the front, back, or through the sides where the plastic side #20, is contoured lower.

Figure 11:
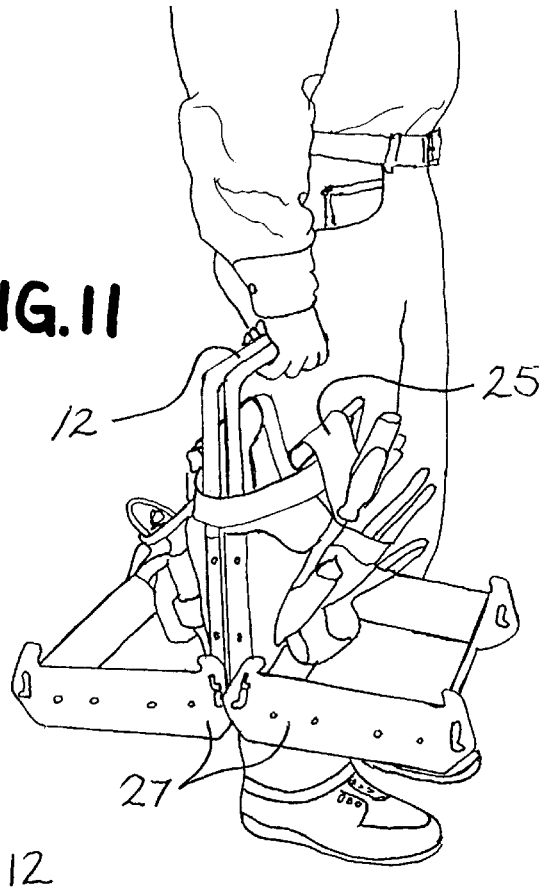
FIG. 11 is a side perspective view of the carrier of FIG. 6, in the collapsed position, with two attached trays and a tool belt, being carried by the handle.

The tray #27, in this embodiment of the invention, must be removed when the invention is used on top of a ladder (see FIG. 3), and when the invention is in the closed position (see FIG. 11).

Figure 5:
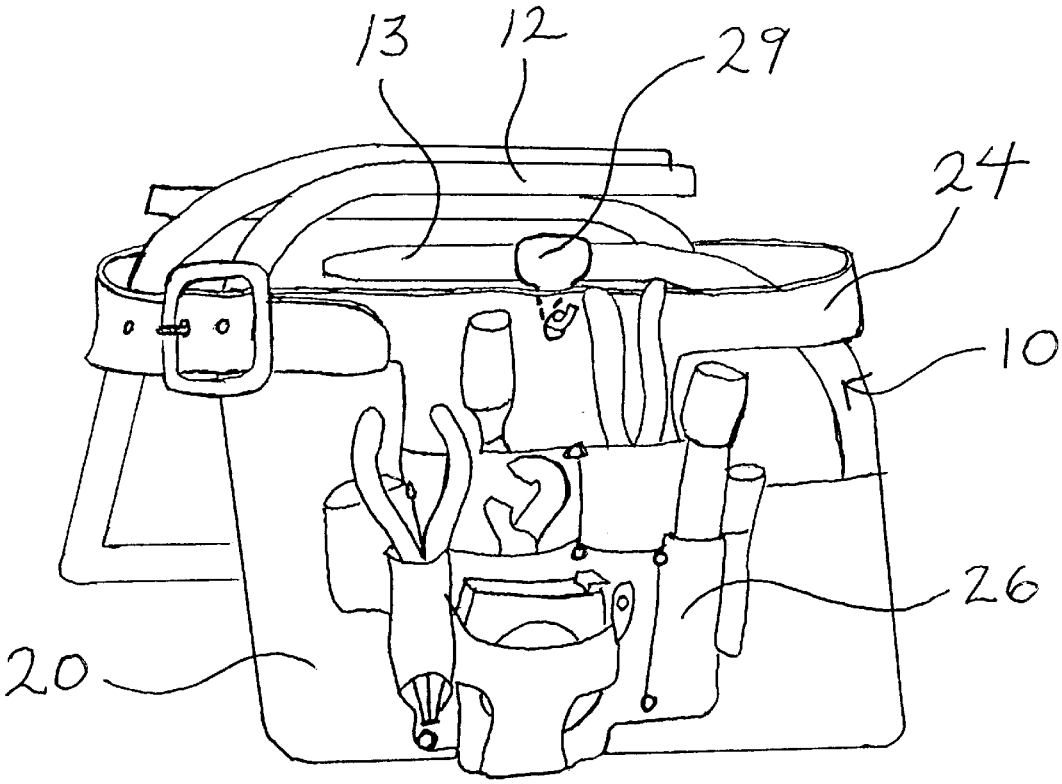
FIG. 5 is a perspective view of the carrier of FIG. 1 mounting a hook member on the horizontal member for engaging and suspending tool belts having no belt loops.

When the tool bags and the waist belt are manufactured as one unit, thus eliminating the belt loop #25, one or more prong hooks #29, are attached to the prong on each frame section, see FIG. 5. A tool belt without belt loops can now be installed on the invention. To attach the tool belt to the framework, a hole (if it is manufactured with one or the worker can create one) through the waist belt above the tool bag is located. The tool belt is placed against the framework's plastic side and hung on the prong hook by inserting the prong hook #29, through the hole in the waist belt, one tool bag on each side of the framework. The invention and attached tool belt can now be transported by lifting the framework handle, see FIG. 5.

DESCRIPTION OF THE IMPROVED PREFERRED EMBODIMENT FIGS. 6, 6*a*, 7, 8, 8*a*, 9, 10, 11, 11*a*

Figure 6:
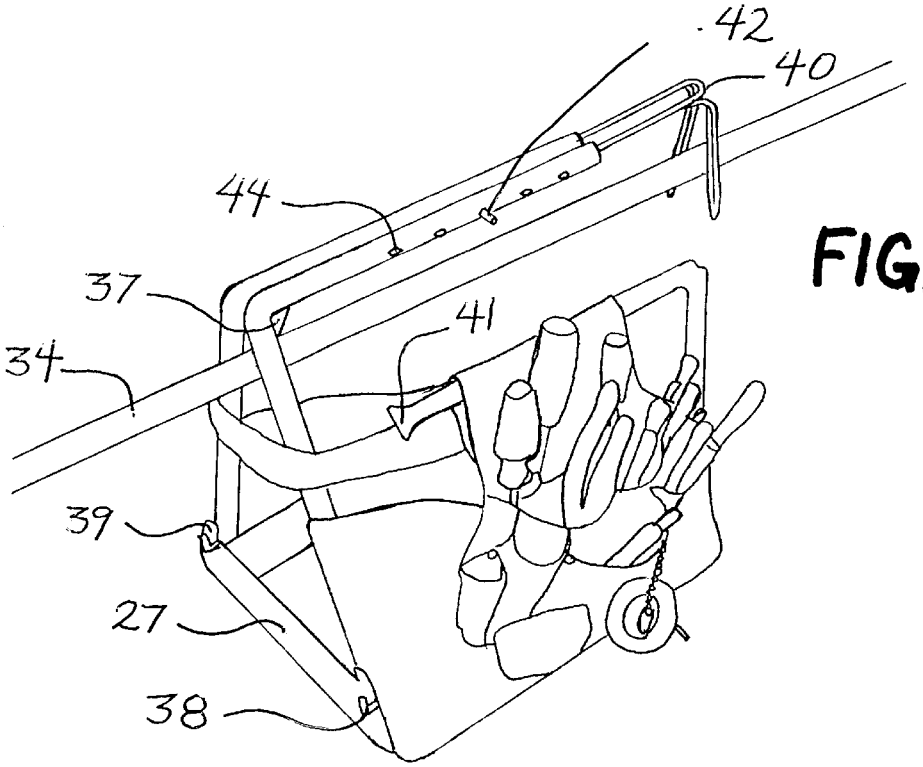
FIG. 6 is a perspective view of the carrier, mounting a handle hook member for suspending the carrier from an elevated support.
Figure 6A:
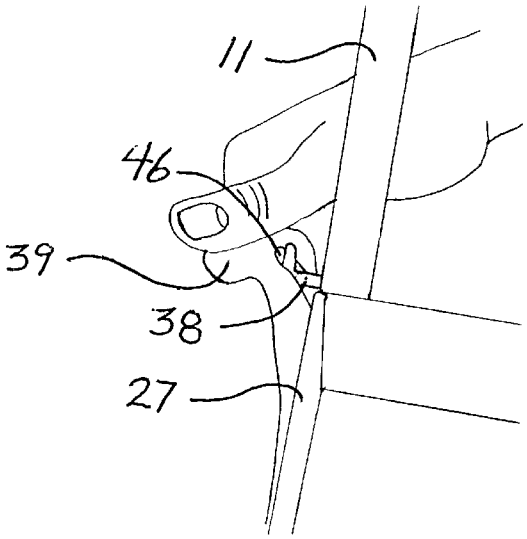
FIG. 6A, is a perspective detail of attachment/detachment of a tray from the carrier.
Figure 7:
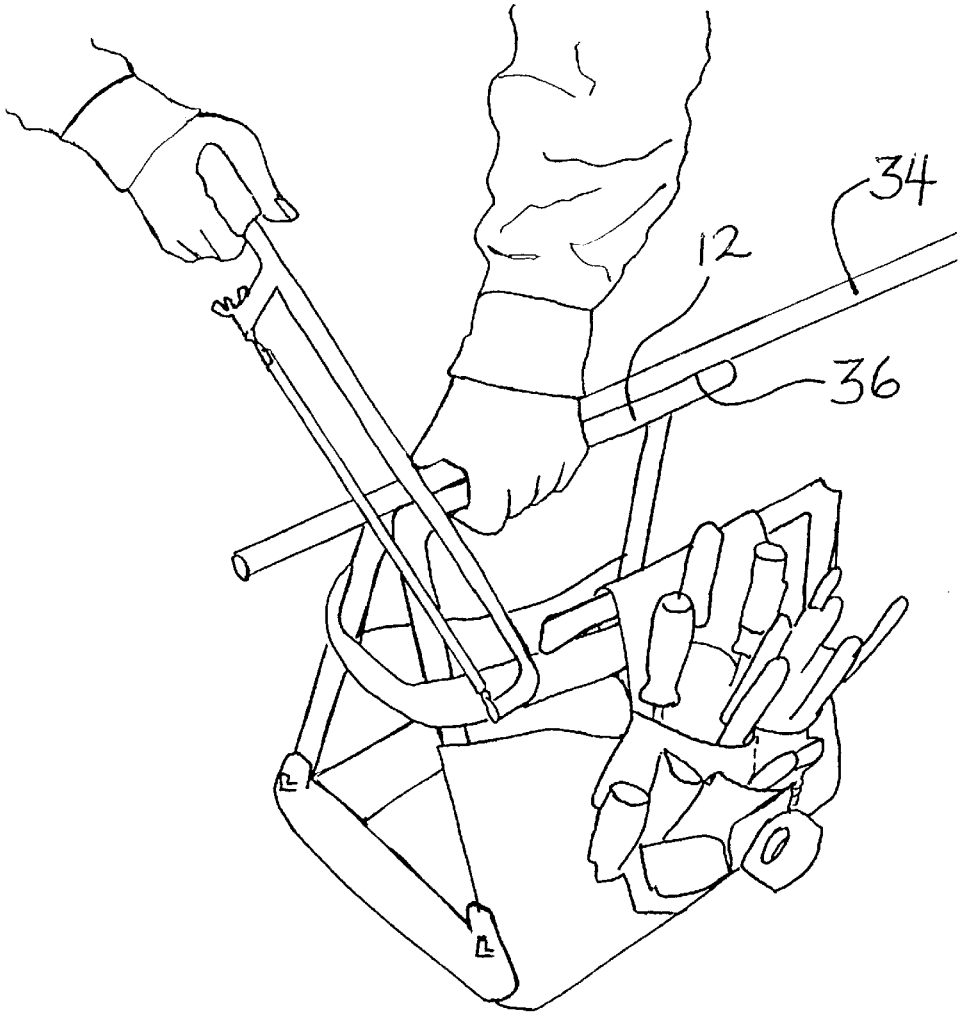
FIG. 7 is a perspective view of the carrier of FIG. 6, showing the framework handle in use as a support surface for materials being worked on, such as for the cutting of the pipe shown.

FIG. 6 through FIG. 11*a* show an improved preferred embodiment, similar in construction to the invention as described in FIG. 1 through FIG. 5, but with several significant differences, which are as follows:

All eight bends in the framework #10, are now sharp 90 degree bends, and each bend is strengthened by brazing a triangle brace #37, on the inside of each bend, see FIG. 6. The brace #37, on the bottom corners are not shown. The brace #37 can be made of a piece of the tubing that the framework is made of, cut into a right triangle with the hypotenuse measuring approximately one inch then brazed into place.

As the prong #13, comes to a point at the prong end taper #14, the width also now increases to form a prong end flair #41, see FIG. 6. The taper # 14 and flair #41 are formed by hammering the prong gradually from round to a flattened point over the last three inches of the prongs length. Smoothing and rounding the corners and edges with a file gives the final shape.

The length of the pipe section between the first and second bends on each frame section (previously described) is now increased by 3 inches in this embodiment. The result is a larger gap between the prong #13 and the handle #12, which allows the worker to reach between the prong and the handle into the interior of the framework, where a tray #27, can be more easily accessed.

The brace #16, (as seen FIG. 1), is now eliminated, see FIG. 6. The hinge #15, becomes the means to limit keeping the frame sections from over-rotating past a functional self-standing or straddling position.

The folding locking brace #16, and tray hook #28, have been eliminated as the means of holding the tray onto the framework. In their place, a tray angle hook #38, (four on the framework), engages a tray tab #39, (four on each tray), see FIGS. 6, 6*a*. The tray angle hook #38, is made of ¼ inch steel rod×1½ inch long, with a sharp 90 degree angle formed in the middle. A hole is drilled through the frame section, 2½ inches up from the bottom edge of the framework. The position of the tray angle hook #38 is similar to, but a little higher than the position of the extension feet #23, as seen FIG. 1. The tray angle hook is oriented upward and brazed or welded onto each frame section, (see FIGS. 6, 8, 10), with a ¼ inch gap left between the frame section and the vertical portion of the tray angle hook, to allow the tray tab #39, to engage the tray angle hook #38, see FIG. 6*a*.

The tray angle hook #38, maintains the function of the extension foot by securely holding the tool carrier between floor joists.

The four tray tabs #39, are constructed using the same type of plastic used in the making of the tray in FIG. 1. One 4×11 inch piece of plastic trimmed to the shape shown in FIGS. 8, 6*a*, will produce the two tray tabs required for one side of the tray. Two such trimmed pieces will be required for each tray, one for the front and one for the back of each tray. Once trimmed to shape the tray tabs can then be pop riveted onto the front and the back side of the tray such that the tray tabs #39, overlap the tray's short side, equally on each side forming an 'ear' shaped overhang see FIG. 8. Each ear shaped overhang has a tray tab hole #46, in the central area, in the shape of an 'L', (or reversed 'L' on the opposite side). The tray tab hole #46, is cut large enough to accept the tray angle hook #38, see FIG. 6*a*. The height of the tray tab hole in the tray tab and the height of the tray angle hook are adjusted so the tray will rest on the ground (before the bottom feet #22, are installed) while the tray angle hook #38 is engaged and resting at the top of the tray tab hole #46 in the tray tab #39. The tray and framework thus aligned make the tray rest slightly off the ground when the bottom feet #22, are installed.

A handle extension hook #40, is made of ¼ inch steel rod, bent and brazed together, to form the shape shown in FIG. 8*a*. A handle extension prong #43, is made to be approximately 9 inches long and has the last ½ inch of each prong #43, is bent outward at 90 degrees, to form a handle extension keeper #42, see FIGS. 8*a*, 9.

A handle hook hole #44, see FIG. 6, is drilled at regular intervals along the length of both sides of the handle #12. The holes #44, are drilled large enough to allow the keeper #42, to protrude through the handle #12, see FIGS. 6, 9.

Figure 11A:
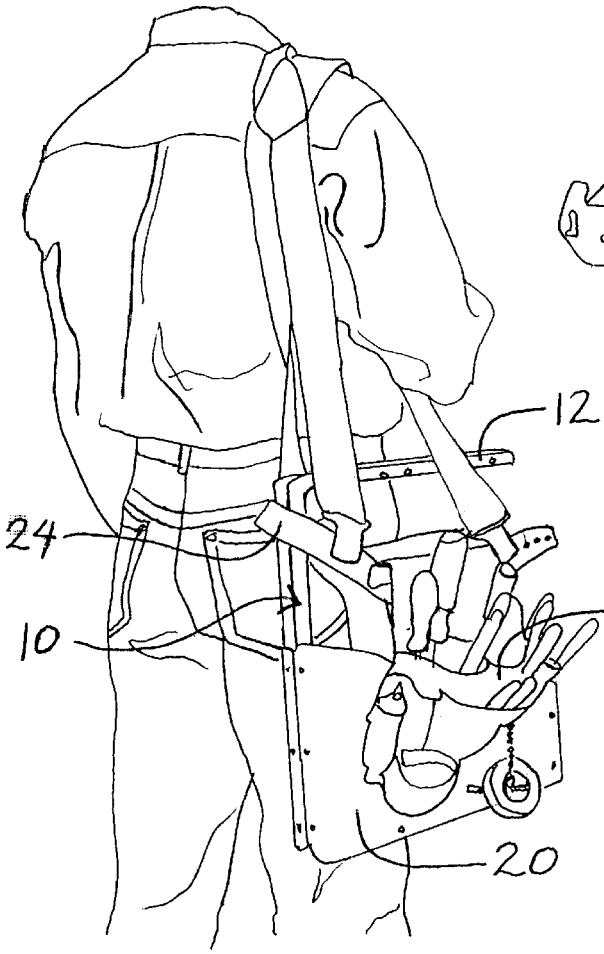
FIG. 11A, is a perspective view of the carrier of FIG. 6 in collapsed, folded condition with suspenders attached to the tool belt, suspending the carrier from a user's shoulder.

A framework extender #45, is constructed of ¼ inch steel rod, bent, shaped and brazed to the shape shown in FIG. 11*a*.

Figure 9:
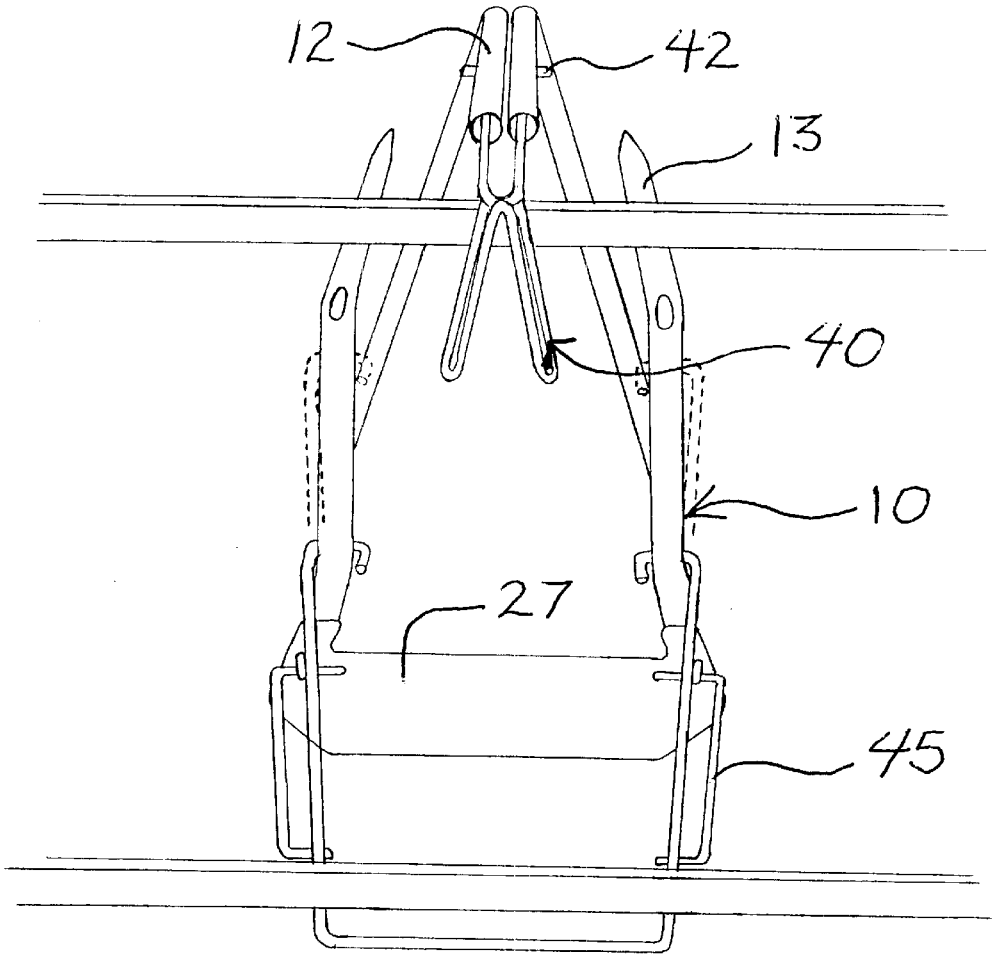
FIG. 9 is a fragmentary perspective view of the carrier of FIG. 6, mounted on a railing of a lift platform, suspended by the hook member and the extension member.

The extender #45, is made to slide up and down the backside of the framework, and rest on the tray angle hook in two positions, see FIG. 9. The extender #45 is also completely removable from the carrier.

OPERATION OF INVENTION FIGS. 6, 6*a*, 7, 8, 8*a*, 9, 10, 11, 11*a*

The invention as shown in FIGS. 6 through 11*a*, operates in the same way as the previous embodiment shown in FIGS. 1 through 5, accept for the following additions and or differences:

The handle #12, of the invention (see FIG. 7), can be used as a working surface, as a means of supporting conduit, cable or other materials during cutting, filing, measuring etc. For cutting metal conduit #34, the conduit is placed on top of and parallel to, the handle, resting in the handle groove #36. The worker grips the conduit and the handle of the invention with one hand, (thus clamping the conduit onto the handle groove) and cuts the conduit with the other.

If the worker is using the invention without a centrally installed tray, the two hinged frame sections #1 1, will automatically close when the framework is picked up by the handle since there is no longer a brace #16, to maintain the framework in the open position, see FIGS. 11, 11*a*.

To install the tray #27, inside the framework, the tray is placed on the ground, then the framework #10, is spread open and lowered onto the tray. By tipping the framework slightly, both the front or both back tray tab holes #46, are engaged first, then the opposite side tab holes #46, engage as the framework is lowered the rest of the way onto the tray. To release the tray from the framework, the same procedure is used in reverse. The tool belt and or tool bags #26, may be left on the tool carrier as the framework is tilted to some degree, due in part to the prong end flair #41 (see FIG. 6), which tends to keep the bag #26, from sliding off the prong #13.

The user is protected from being impaled or injured by the prong end flair #41, due to the structure of the framework #10, extending beyond the exposed pointed portion of the end flair #41, see FIG. 6. If the worker should bump into or fall on the invention, the vertical 'V' shaped portion of the framework #10 would fend off the impact thus protecting the worker from injury.

Figure 10:
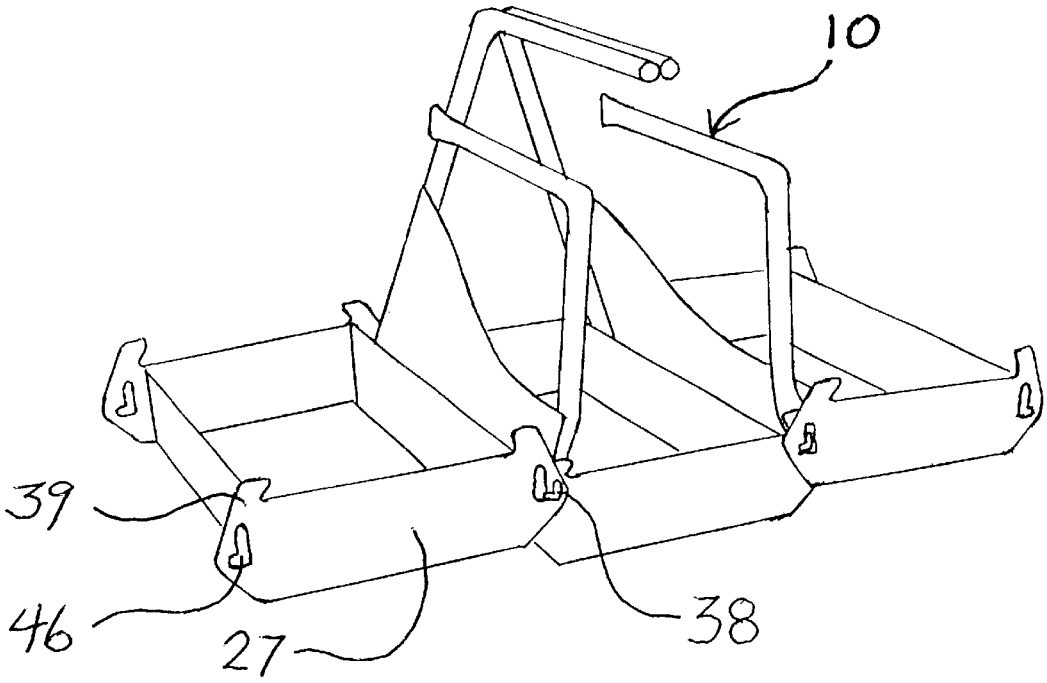
FIG. 10 is a perspective view of the carrier of FIG. 6, with three trays attached to the carrier.

In the current embodiment, the tray or trays may be mounted on one side, both sides, or inside the framework, three trays at the same time see FIGS. 8, 10, 11.

To install a tray on the side of the framework #10, secure the framework (on the ground, on a ladder or other supporting object), in a secure position with the frame sections spread apart or together. The tray can then be "hung" on the tray angle hooks #38. Hold the tray with both hands on the corners of the tray that will adjoin the plastic side #20, one thumb on each tray tab #39. Bend the flexible tray tabs outward, then guide the tray tab holes onto the tray angle hooks, then release the tray tabs, see FIG. 6*a*.

The trays (when engaged to the side of the framework of the invention) hang from the tray angle hooks in one of two positions. Either from the top of the 'L' or the opposite end of the 'L' shaped tray tab hole #46. The particular position of the hook #38 inside the tray tab hole will change the attitude of the tray in relation to the framework. Using the top of the 'L' of the tray tab hole, holds the tray substantially level when the invention is being used in the framework collapsed or closed position, see FIG. 11. The other position, where the tray angle hook rests in the bottom end of the 'L' shape, holds the tray in a substantially level position when the framework is spread open, see FIG. 8.

The handle extension hook #40, inserts into the handle #12, by squeezing the handle extension prongs #43, together and maintaining pressure until the desired depth of insertion is achieved. By releasing the squeezing pressure on the prongs #43, the keepers #42, will spring outward and engage the holes #44. The hook #40, can be used to secure the invention onto a stepladder (see FIG. 8), or on the railing of a lift platform (see FIG. 9) or many other objects where the worker wants the invention close at hand. To release the hook #40, the prongs #43, are squeezed together while the hook #40, is withdrawn. Turning the hook #40, 90 degrees to either side during insertion or withdrawal will disallow the keeper #42 from engaging every hole in the handle, thus saving time in the insertion or withdrawal operation.

The purpose of the framework extender #45, is to increase/extend the height of the tool carrier framework, see FIG. 9. Thus making the carrier usable on railings (lift platforms for example) where the distance between the top railing and the next railing down may be too great for the tool carrier framework to stably span without the extender #45. The extender #45, attaches to the back of the framework when the framework is in the open self standing position and is completely removable when not needed.

The extender #45, will attach and hang from the hooks #38 in a stored or deployed position. To deploy the extender #45 from the stored position, lift the extender #45 off the hook #38, slide the extender down the framework until the extender re-engages the hooks #38 in the new lowered position, see FIG. 9. To store the extender on the tool carrier, raise the extender #45, and hang it on the hook #38 in the raised position.

To use the extender #45 (for example; on a lift platform railing), insert the handle extension hook #40, into the handle #12, to the desired depth. Be sure the handle extension keeper #42, is engaged through both handle hook holes #44. Attach the framework extender #45, in the raised, stored position and hang the tool carrier by the hook #40 on the railing. Once the tool carrier hook #40 is engaged on the railing, the extender #45, may be lowered and engaged with the angle hook #38. The tool carrier can now rest on the extender #45, against on the lower railing.

To move the tool carrier, simply slide or lift and relocate the tool carrier to another position on the railing.

The tool carrier may be lowered to the ground with the extender #45, in the deployed, lowered position. The extender #45, will automatically disengage the hook #38, and slide up the framework allowing the tool carrier to sit flat on the ground without damaging the extender #45.

If suspenders are attached to the tool belt, the worker may choose to transport the invention by wearing the attached suspenders over one shoulder, see FIG. 11*a*. This orientation allows for hands free transportation and can be used as a working position with the tools in good proximity at the workers side.

DESCRIPTION OF INVENTION FIG. 12

Figure 12:
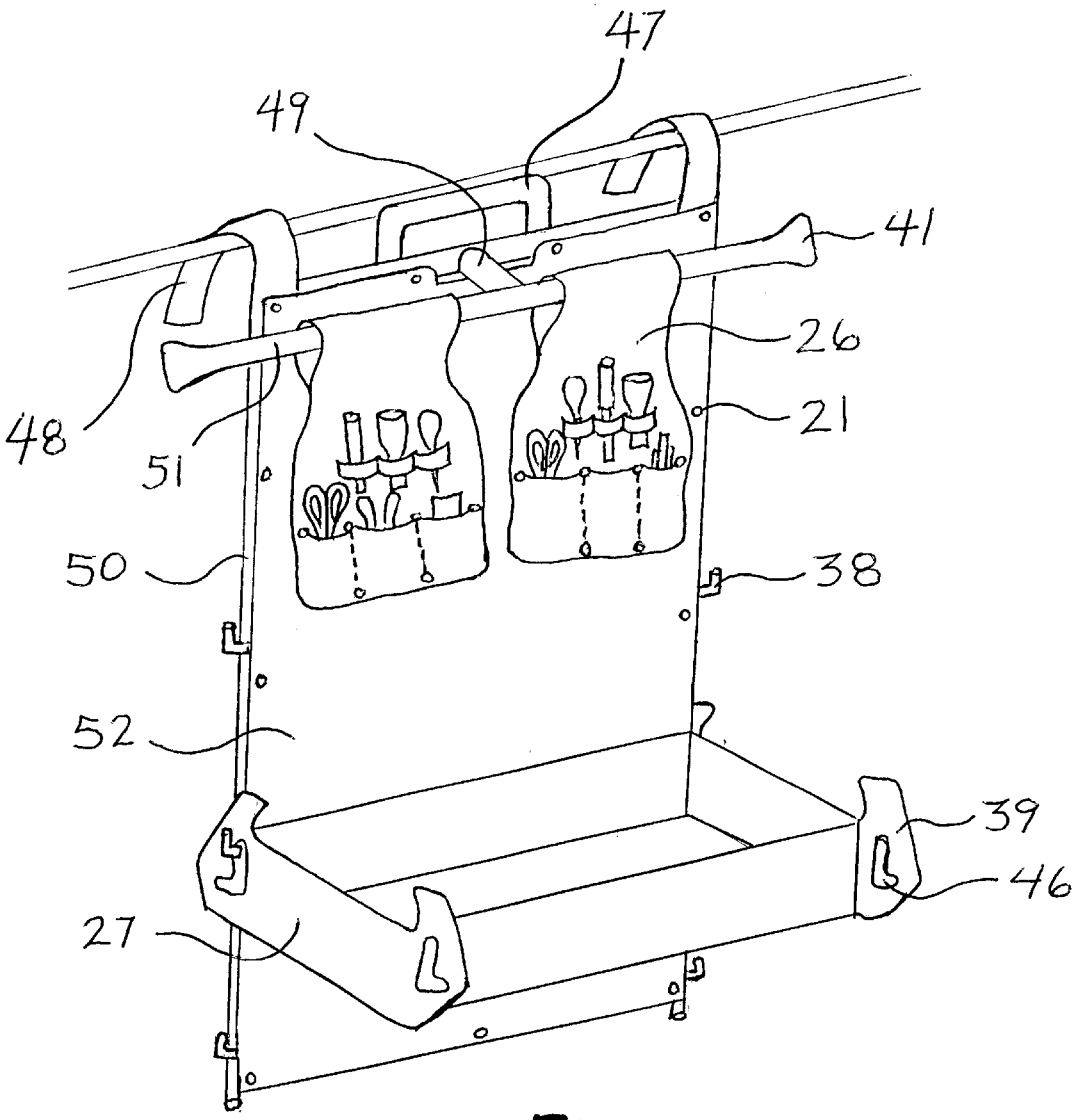
FIG. 12 is a perspective view of an alternate embodiment of the invention hanging on a pipe, with a tool belt and a tray attached.

The invention shown in FIG. 12 is a different embodiment from FIGS. 1 through 11*a*, but with many similarities in function and some shared part names.

FIG. 12, shows a different embodiment of the invention. A frame structure #50, made of the same metal tubing as the invention in FIG. 1, is brazed or welded into a rectangular shape approximately 18 inches wide by 24 inches long with extra length left on the long sides of the rectangle to form a frame hook #48. The hook is made by flattening the ½ inch pipe with a hammer then shaping the flattened section into a curve large enough to engage a pipe or wire or beam from which the invention could be hung, see FIG. 12.

A frame handle #47, made of ½ inch steel tubing, bent and shaped to a broad and inverted "U" shape, is brazed or welded to the top horizontal segment of the frame #50, to function as a handle for transporting the invention, see FIG. 12.

A double prong #51, is constructed of the same ½ inch steel tubing as the frame and measures a few inches longer than the width of the frame #50. Each end of the prong #51 has a prong end flair #41. A frame-prong brace #49, is brazed or welded onto the mid point of the top horizontal segment of the frame #50, protruding outward. The prong #51, is then brazed or welded onto the brace #49, at the mid point of the prong #51, parallel to and at the same height as the upper segment of the frame #50. The flair #41 is oriented vertically to make insertion into the tool bags #26, easy (see FIG. 12).

A tray angle hook #38, is brazed or welded onto the frame #50, at intervals along both vertical sides of the frame to accommodate trays for extra parts and tools, see FIG. 12.

A plastic sheet #52, (the same type of plastic as used in plastic side #20, fig. #1), is laid on top the frame #50, secured by a pop rivet #21, one every five inches or so along the edge of the plastic sheet to secure it to the frame #50.

The tray #27, is made in the same manner as in FIGS. 6 and 8, but with extra length to accommodate the increased width of the frame structure #50.

OPERATION OF INVENTION FIG. 12

The invention will hang from a wire, pipe, beam, railing, or a variety of objects. To install, lift the invention by the handle #47, and engage the hook #48 onto the object, allowing the invention to hang downwards.

The tool belt with tool bags attached or just the tool bags themselves may be threaded onto the prong #51 by passing the belt loop #25 onto the prong #51, and pulling the tool bag onto the prong to the desired position. If two tool bags are present, use the same procedure to install the second tool bag opposite the first on the prong #51.

To install a tray or trays onto the invention; the trays are "hung" on the tray angle hooks #38. Hold the tray with both hands on the corners of the tray #27, that will adjoin the plastic sheet #52. With one thumb on each tray tab #39, bend the flexible tray tabs outward, then guide the tray tab holes #46, onto the hooks #38, then release the tabs #39 to engage the hook #38, see FIG. 6*a*. The tray will then hang securely from the hooks #38. To remove the tool bags or belt or the trays from the invention, the reverse procedure is used.

CONCLUSIONS, RAMIFICATIONS AND SCOPE

Thus the reader will see that the tool belt carrier of the invention can be used with common tool belts used in the trades. The carrier is of simple design, quick and easy to transfer the tool belt/tool bags back and forth from the workers body to the tool carrier. The tool carrier is self-standing, folds for easy storage and carrying, attaches to a variety of objects, and will carry a number of trays into which extra tools and parts may be stowed. The carrier's "A" frame shape; display's the tools at a most advantageous angle, has a low center of gravity for maximum stability and is easy to carry with the large handle at the top.

While the above description contains many specificity's, these should not be construed as limitations on the scope of the invention, but rather as an exemplification of one preferred embodiment thereof. Many other variations are possible, for example:

The framework need not be hinged but could be permanently in the open position, with an integral or removable tray.

Detachable tool trays could be affixed to the front and back of the framework as well as to the inside and sides as described. This could easily be accomplished by adding holes in the long side of the tray for the tray angle hooks to engage. Thus a tray or trays could be attached to any and all sides of the tool carrier.

Alternate means of attaching the tool belt to the caddy could be used such as clips or clamps.

The tray can have attached handles to make it more useful as a tool carrier when used separately from the framework.

The framework could be of many shapes, sizes and configurations and be made of aluminum, plastic or other materials.

If the basic framework were made taller, the framework extender would not be necessary.

The tool carrier frame sections could be hinged in a variety of configurations. For example; vertically hinged, joining the frame sections along the front of the framework, instead of horizontally hinged along the top at the handle as shown.

Alternate means of attaching and hanging the tool carrier to railings and other objects could be used. For example a length of hook and loop material attached to the handle could grip a pipe or railing.

A ruler could be drawn on the handle for measuring when cutting conduit or pipe.

Alternate ways of securing the tool bags from slipping off the framework prongs use could be used, (instead of or in addition to the prong end flair). For example; restraining pins inserting through the prongs at the ends or a notch cut into the prong end flair to catch the tool bag before it slips off.

Specially designed trays for specific purposes. For example; trays with internal dividers, enclosed drawers, different size trays. Specially designed tool bags, made for specific purposes, to fit the carrier with or without a belt.

The invention would support a tool belt with no trays at all.

Various ways of attaching the trays to the caddy could be used. For example; a hook and loop fastener.

The tool carrier could be designed to open or close by squeezing or releasing the handle where the two halves of the framework come together.

The prongs need not be off-set from the plain defined by the framework side.

Other methods of protecting the worker from being impaled or injured by the prongs. For example; the prongs could be a blunt shape on the end and still insert into the tool bag belt loops.

The embodiment in FIG. 12 needs no supporting base since it hangs in the working position, but it could be easily fitted with a base to make it self standing.

Accordingly, the scope of the invention should be determined not by the embodiments illustrated, but by the appended claims and their legal equivalents, rather than the examples given.

Having described my invention and the manner in which it may be used, I claim:

1. For use with a tool belt of the type having a waist-encircling belt member supporting at least one depending tool holder or pouch secured thereto by belt loops, a tool belt carrier apparatus for releasably receiving and supporting a tool belt in a generally upright, suspended condition for ready access to tools and other contents of a tool belt on the carrier apparatus, the carrier apparatus comprising:

a) a substantially rigid, vertically upstanding framework having a bottom base end configured for disposition on an underlying floor surface to support the framework in a stable, free-standing, substantially upstanding, operative condition on an underlying, supporting floor surface, and b) a tool belt loop-engaging support member on the framework configured to releasably receive a belt loop of a tool belt to support a tool belt by the belt loop in secure, substantially suspended condition therefrom with depending tools and pouches of a tool belt retained above said bottom base end of the framework and an underlying floor surface supporting the framework for ready and easy access thereto by a user of the carrier apparatus.

2. The carrier apparatus of claim 1 including a carrying handle mounted on the framework and configured for hand grasping by a user of the carrier apparatus to lift and carry the framework and a tool belt supported in suspended condition thereon.

3. The carrier apparatus of claim 1 wherein said framework mounts projecting floor joist extension foot members configured to engage a pair of adjacent, spaced apart floor joist members of a building construction and support said framework thereon in upstanding, operative condition spanning between adjacent, spaced apart floor joist members.

4. The carrier apparatus of claim 1 including at least one removable tray member releasably mounted on said framework and configured to hold loose objects when said framework is disposed in said substantially upstanding, operative condition.

* * * * *